US006409379B1

(12) United States Patent
Gabathuler et al.

(10) Patent No.: US 6,409,379 B1
(45) Date of Patent: Jun. 25, 2002

(54) SELF-WINDING WATCH

(75) Inventors: Jacques Gabathuler, Geneva; Cédric Jacot, Meyrin; Christophe Lyner, Fribourg; David Nicolet, Prangins, all of (CH)

(73) Assignee: Montres Rolex S.A., Geneva (CH)

( * ) Notice: Subject to any disclaimer, the term of this patent is extended or adjusted under 35 U.S.C. 154(b) by 0 days.

(21) Appl. No.: 09/542,077

(22) Filed: Apr. 3, 2000

(30) Foreign Application Priority Data

Apr. 23, 1999 (EP) ..... 99810342

(51) Int. Cl.[7] ..... G04B 3/12
(52) U.S. Cl. ..... 368/150; 368/152
(58) Field of Search ..... 368/207, 208, 368/141, 151, 152

(56) References Cited

U.S. PATENT DOCUMENTS 2,867,971 A 1/1959 Bertsch et al.
4,213,293 A * 7/1980 Mabuchi et al. ..... 368/152

FOREIGN PATENT DOCUMENTS

CH 348 921 A 10/1960
CH 1 237/69 A4 5/1971
EP 0 278 338 A 8/1988

* cited by examiner

*Primary Examiner*—Bernard Roskoski
(74) *Attorney, Agent, or Firm*—Henderson & Sturm LLP

(57) ABSTRACT

A self-winding watch includes a self-winding mass having a central part surrounded by raceways of a ball bearing. One raceway is integral with the central part. Another raceway is integral with means for positioning and means for removably fastening to watch frame. A reduction gear train for connects the self-winding mass to a barrel arbor. A reversing mechanism converts the two-directional rotational movement of said self-winding mass into a one-directional rotational movement. Two first pinions of the reversing mechanism freely pivot, concentrically, with said central part. Each of the first pinions meshes with a planet pinion. The pivot pin is integral with the central part and the toothing is shaped so as to allow only unidirectional rotations of said first pinions in two opposed respective directions of rotation. The first pinions are integral with two second respective moving parts of the gear train, the directions of rotation of which are opposite, one with respect to the other.

19 Claims, 3 Drawing Sheets

SELF-WINDING WATCH

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates to a self-winding watch comprising a self-winding mass, a ball bearing in order to make this self-winding mass pivot about an axis of the watch's frame, a reduction gear train for connecting this self-winding mass to a barrel arbor and a reversing mechanism, in order to convert the two-directional rotational movement of said self-winding mass into a one-directional rotational movement, transmitted to said barrel arbor.

2. Description of the Prior Art

Most self-winding mechanisms are provided with a reversing mechanism in order to allow the barrel arbor, integral with the internal end of the barrel spring, to rotate in the direction of loading of this spring, whatever the direction of rotation of the self-winding mass. Without such a reversing mechanism, half of the angular movements of the self-winding mass are in fact lost, therefore requiring twice the movement of the self-winding mass for the same degree of loading of the barrel spring.

The problem posed by reversing mechanisms is that of size, both in terms of area and in terms of height, whatever the system chosen. It is quite obvious that this problem is all the more difficult to solve the smaller the diameter of the movement. When the reversing mechanism is located at the start of the kinematic chain connecting the self-winding mass to the barrel arbor, there is also the problem of an accumulation of mounted devices pivoting about the central axis of the movement and therefore an increase in the thickness of the latter. This problem is also all the more irksome the smaller the diameter of the movement.

A typical example of this accumulation of moving parts at the center of the movement is illustrated, for example, in CH-363,298 in which, in addition to the indicating wheelwork of the watch necessarily placed at the center of the movement, a bridge has to be added for fastening the pivot pin for the self-winding mass, the plate of this self-winding mass mounted so as to pivot on this pin, and two reversers between this bridge and this self-winding mass plate, the system for unidirectionally driving each of these reversers, as well as the spaces necessary between these various superposed elements in order to allow them to rotate about this same pivot pin.

Among the many solutions proposed for solving the space problems, it has already been disclosed, in CH-329,448, to use the self-winding mass to house the reversing mechanism therein. The drawback of such a solution is that it reduces the inertia of this mass, since it is necessary to hollow it out in order to house therein this mechanism which includes a large proportion of empty space. Consequently, the torque which may be transferred to the barrel spring in order to load it is reduced.

According to other solutions, (CH-308,939 and CH-308,940), the reversing mechanism is mounted coaxially on the barrel arbor. Now, the volume that can thus be subtracted from the barrel in order to house the drive spring therein, reduces the energy capable of being stored in the latter.

BRIEF SUMMARY OF THE INVENTION

The object of the present invention is to remedy, at least partly, the various drawbacks mentioned above, especially by reducing the size of the self-winding mechanism and by allowing a more rational use of the space, particularly at the center of the movement.

For this purpose, the subject of the invention is a self-winding watch as disclosed herein.

One of the main advantages of this invention consists in using a large-diameter ball bearing, making it possible to leave a substantial volume at the center of the movement for housing the reversing mechanism. The space saved at the center of the movement does not require the height of the movement to be increased since the raceways of the ball bearing, serving for pivoting the self-winding mass on the frame of the watch, surround the reversing mechanism and therefore can be located naturally at the same level as the latter. This arrangement therefore allows space to be saved in the height direction, since it avoids the abovementioned superposition.

By virtue of this arrangement, the central part of the watch's frame is no longer occupied by the pivoting members of the self-winding mass, which are moved away toward the outside, although its pivot axis coincides with the center of the movement and although the diameter of this mass therefore remains maximum. The pinions of the reversing mechanism, and therefore those which drive the reduction wheelwork may consequently have a small diameter, given that the central part of the movement is thus freed and that these pinions lie on the inside and no longer on the outside of the ball bearing. The fact of having small-diameter drive pinions for the reduction wheelwork makes it possible to reduce the number of moving parts of the reduction gear train, given that these pinions already constitute a first reduction stage. The fact that the reversers are fastened to the oscillating mass also makes it possible to limit the dead zone, during reversal in the direction of rotation of the self-winding mass, to that of the reversing pinions.

Thanks to the central position of the double reverser and to the small diameter of the drive pinions which are fastened to them, the reduction wheelwork may also occupy a position grouped relatively around the center of the movement and thus can leave the periphery free for the self-winding mass. The torque which can be transferred by the latter depends in fact on its inertia and, consequently, on the mass which is placed far from its pivot pin.

The present invention therefore makes it possible to save space also in the plane, thanks to the grouping of the wheelwork at the center and to the smaller number of moving parts of the reduction wheelwork.

BRIEF DESCRIPTION OF THE SEVERAL VIEWS OF THE DRAWINGS

Further advantages will appear in the course of the description which follows, relating to one embodiment of a self-winding watch forming the subject of the present invention, this description being given by way of example and illustrated with the aid of the appended schematic drawing in which.

DETAILED DESCRIPTION OF THE INVENTION

Only the parts relating to the self-winding mechanism of the watch are shown, the rest of the watch's mechanism not being needed for understanding the present invention.

Figure 2:
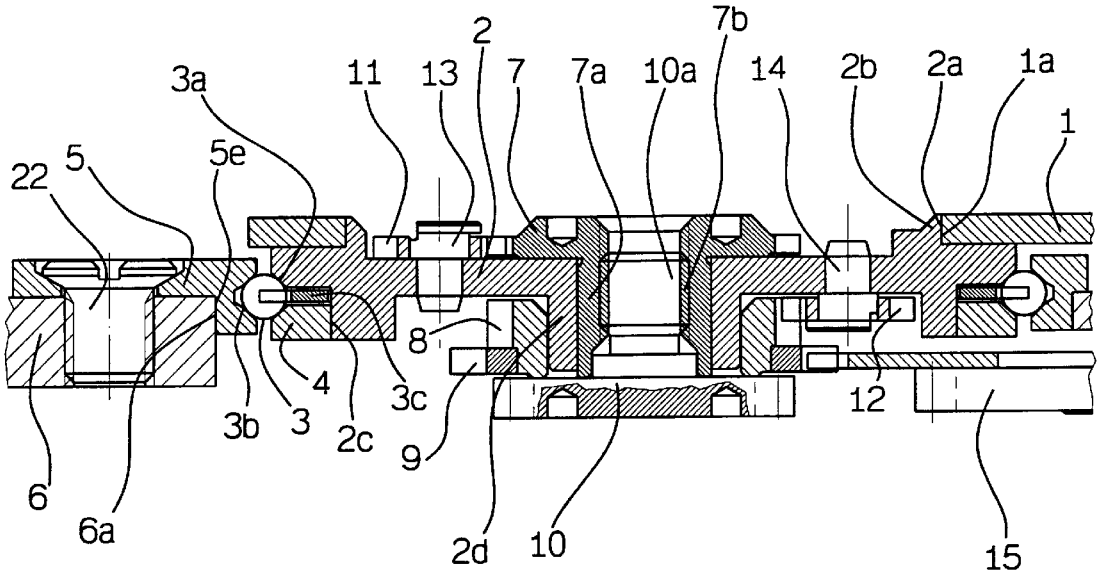
FIG. 2 is a partial sectional view on the line II—II in FIG. 1.

This winding mechanism comprises a self-winding mass formed in two parts, namely a central part 2 to which a generally semicircular external part 1 is fastened. For this purpose, the external part 1 has a central opening 1*a*, engaged on an annular bearing face 2*a* of the central part 2 (FIG. 2). An oblique annular face delimits, with the bearing face 2*a*, a projection 2*b*. This oblique face of the projection 2*b* serves as a bearing surface in order to make it possible to create, using a suitable tool, a centripetal deformation on the bearing face 2*a* against which the opening la is fitted, thus allowing the two parts 1 and 2 forming the self-winding mass to be fastened together.

As illustrated in FIG. 2, a ball bearing 3 is provided around the central part 2. An inner raceway 3*a* is provided, on the one hand, around the periphery of this central part 2 and, on the other hand, around the periphery of a ring 4 forced onto a cylindrical portion 2*c* of the central part 2 and serving to retain a bearing race 3*c*. An outer raceway 3*b* is provided in an opening in an annular member 5 for positioning a bridge 6 and for fastening the latter to the watch's frame, said bridge being provided with a cylindrical opening 6*a* (FIG. 2) for accommodating a complementary cylindrical surface 5*e* of the annular member 5.

Figure 1:
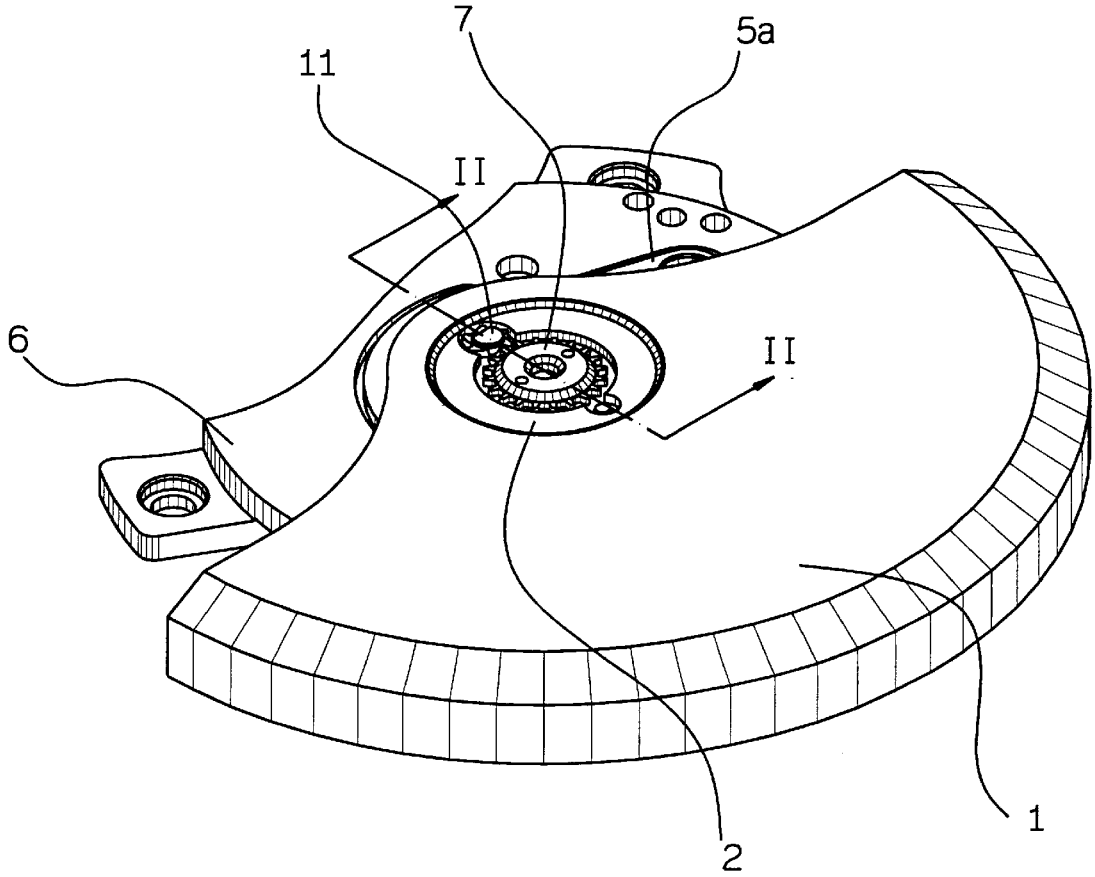
FIG. 1 is a perspective view of part of the watch's frame with the self-winding mass.
Figure 3:
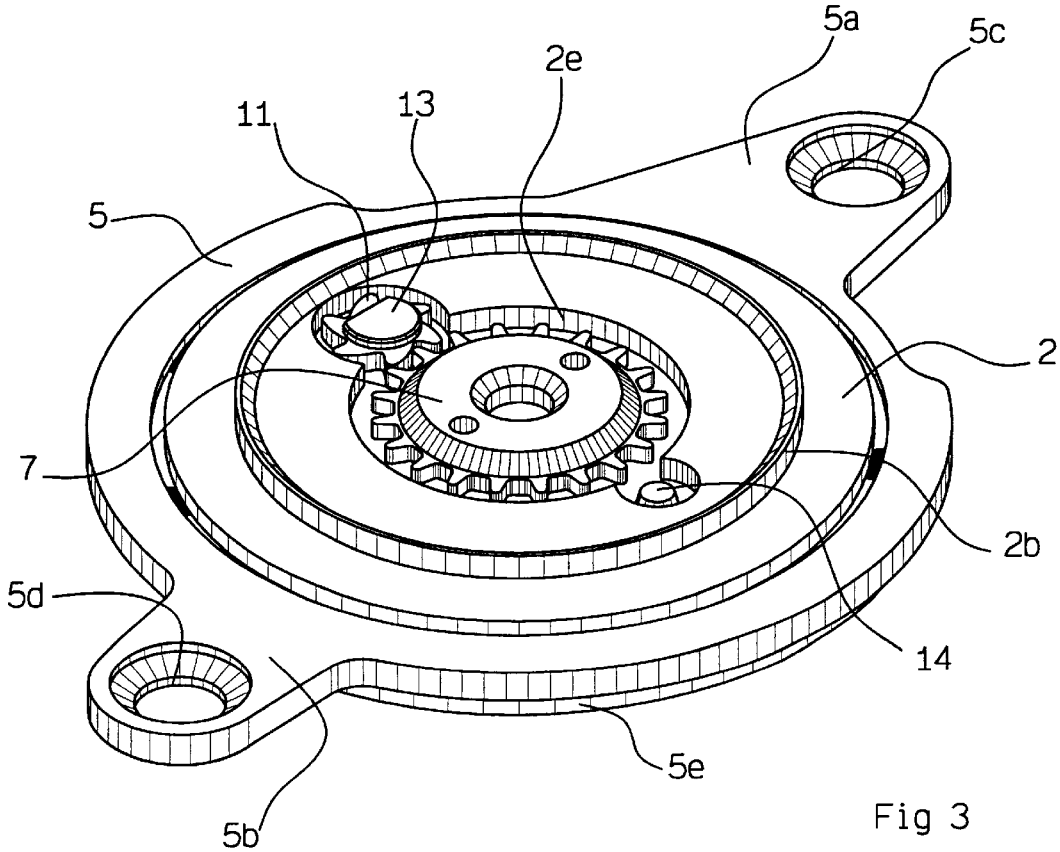
FIG. 3 is a perspective view of the central part of the self-winding mass.

These complementary cylindrical surfaces 5*e*, 6*a* serve to position the self-winding mass 1, 2 concentrically at the center of the watch's frame. The annular member 5 also includes at least two diametrically opposed fastening tabs 5*a*, 5*b* (FIG. 3), which extend to the outside of its cylindrical surface 5*e*. These fastening tabs 5*a*, 5*b* are penetrated by openings 5*c*, 5*d* surrounded by respective screw countersinks, in order to allow these tabs 5*a*, 5*b* to be fastened to the bridge 6 of the watch's frame (FIG. 1) by means of screws 22, one of which may be seen in FIG. 2.

A tubular portion 2*d* is provided concentrically with the axis of rotation of the central part 2 of the self-winding mass and extends downward. A first reverser 7 is placed in a countersink 2*e* (FIG. 3) formed concentrically with the pivot axis of this self-winding mass, on the upper face of the central part 2. This first reverser 7 (FIG. 2) has a tubular pivoting part 7*a* engaged in the cylindrical bore of the tubular portion 2*d* which serves as a bearing for it.

A second reverser 8, integral with a pinion 9, is engaged from below onto the external cylindrical surface of the tubular portion 2*d* which serves as a bearing for it. A pinion 10, integral with a threaded rod 10*a*, is screwed from below into the tubular part of the first reverser 7, having an internal thread 7*b* complementary to the thread on the rod 10*a*. This assembly makes it possible to fasten this pinion 10 to this reverser 7 and to axially retain the reverser 8 and the pinion 9 on the tubular element 2*d*, while allowing them to rotate freely.

Figure 4:
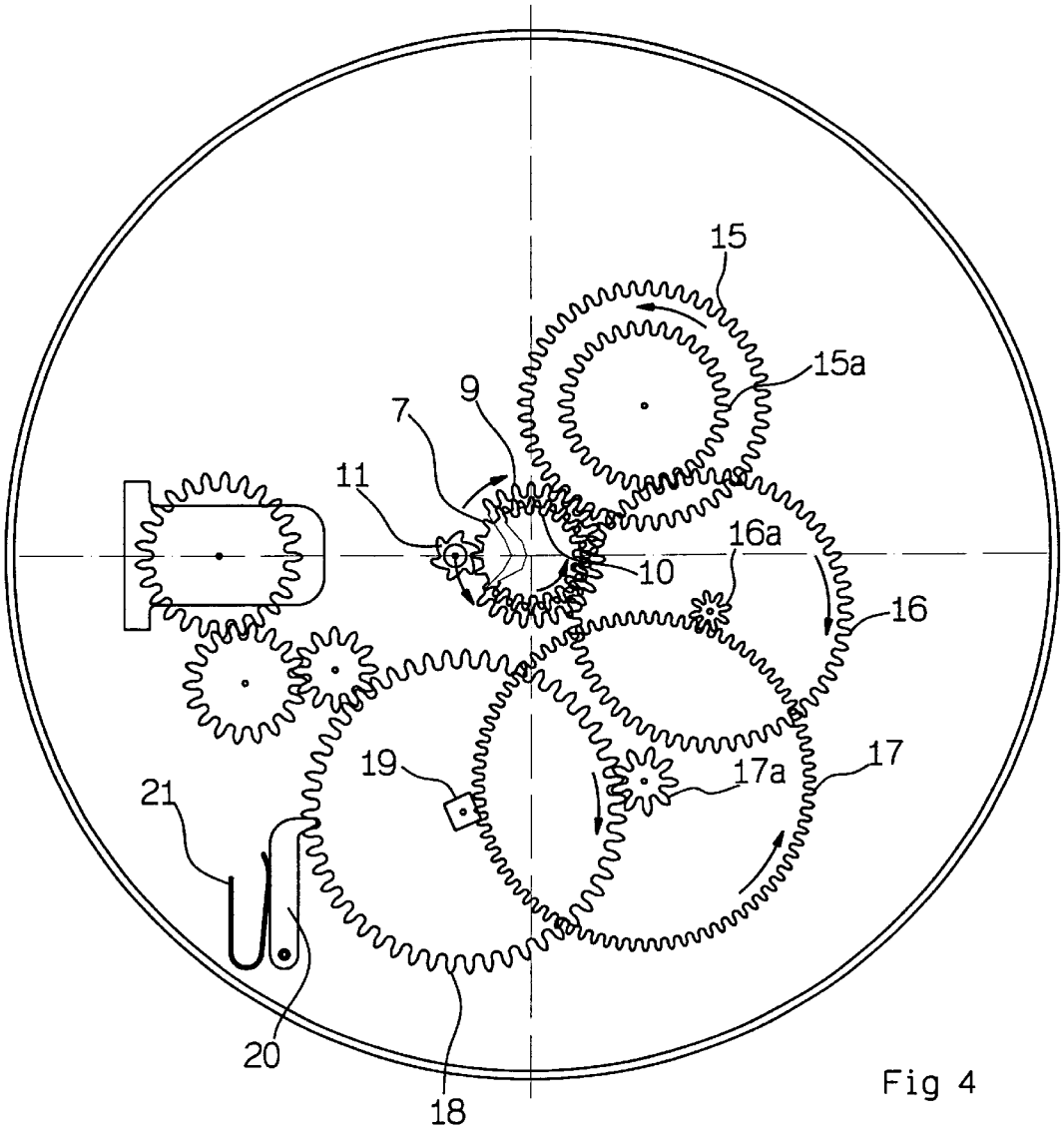
FIG. 4 is a plan view illustrating the position of the moving parts of the winding wheelwork on the frame.

Each reverser 7, 8 meshes with a respective planet pinion 11, 12 mounted so as to pivot on a respective tenon 13, 14. These tenons 13, 14 are forced on, respectively from above and from below the central part 2 of the winding mass. As may be noted in FIGS. 3 and 4, the toothing of each planet pinion 11, 12 has a shape which allows each reverser-planet pinion system 7, 11; 8, 12 to rotate only in one direction, the rotation of the respective planets 11, 12 in the reverse direction causing the respective reversers 7, 8 to lock, which thus become rotationally integral with the winding mass 1, 2.

The two reversers 7, 8 and their respective planets 11, 12 are mounted coaxially with the pivot axis of the self-winding mass, but their respective pivot axes are as it were rotated through 180° one with respect to the other. In other words, one of the reversing systems, comprising the reverser 7 and its planet 11, mounted on the upper face of the central part 2, has a mirror symmetry with respect to the other reversing system comprising the reverser 8 and its planet 12, mounted on the lower face of the central part 2. Consequently, their respective relative rotations are reversed with respect to the common axis of rotation, when they are observed from the same side as the self-winding mass.

Consequently, since the pivot pins of the planets 11, 12 are always integral with the self-winding mass 1, 2, when the latter lock the reversers 7, 8, respectively, they make them rotationally integral with this winding mass 1, 2 and therefore allow them to transfer the rotation of the latter. In the reverse direction, the reversers 7, 8 are free with respect to the winding mass 1, 2 and therefore do not transfer any movement. However, since the two reversers work in reverse directions one with respect to the other, there is therefore always one of them which transfers the rotation of the self-winding mass.

This transfer of the rotation, and therefore of the drive torque of the winding mass, is accomplished by the pinions 9, 10 integral with the reversers 8, 7, respectively. Consequently, since these pinions 9, 10 rotate, like the reversers 8, 7, in two opposite directions, it is necessary for each of them to mesh with two different moving parts of the reduction gear train, which themselves rotate in opposite directions one with respect to the other.

Thus, the pinion 9, integral with the reverser 8, meshes with a first moving part 15 of the reduction gear train while the pinion 10, integral with the reverser 7, meshes with a second moving part 16 of this same reduction gear train. The first moving part 15 meshes with this second moving part 16 via a pinion 15*a*. A third moving part 17 meshes with a pinion 16*a* of the second moving part and its pinion 17*a* finally meshes with a barrel ratchet wheel 18 integral with the shaft 19 of the barrel to which the internal end of the barrel spring (not shown) is fastened. As in all watches, this ratchet wheel 18 engages with a pawl 20 stressed by a spring 21, which allows it to rotate only in the direction of loading of the the barrel spring.

The self-winding mass 1, 2 therefore carries, at its center, two pinions 9, 10 whose diameters may be small since the mass pivots about the central part 2 bearing the reversing mechanism. This makes it possible to achieve reduction directly from the winding mass 1, 2 and in both directions of rotation of the latter.

The reversing mechanism forms a single module, mounted on the central part 2 of the self-winding mass. In order to remove it, all that is required is to unscrew the two screws which fasten the tabs 5*a*, 5*b* of the annular fastening member 5 to the watch's frame 6. This allows very easy access to this mechanism, in order to clean and lubricate it and to carry out inspection operations.

As has already been mentioned, when the pinions 9, 10 transfer the rotational torque from the winding mass to the reduction gear train, they are rotationally integral with the winding mass and therefore do not rotate on their pivots. The efficiency is therefore excellent since it is not reduced by the frictional forces resulting from the pivoting.

Since the two planets 11, 12 are identical, there is no risk of error between that on top and that underneath. Their pivoting on tenons 13, 14 generates no cantilever. Fastening via these drive-in tenons avoids the risk of losing these small planet pinions 11, 12.

Unlike certain reversing mechanisms in which the reversing pinions mesh with internal toothing which can be formed only by cutting, the toothing of the entire mechanism may be formed by hobbing. This makes it possible to produce finer toothing than by cutting. Forming the teeth by hobbing is more accurate than by cutting, both from the standpoint of the regularity of the profile of the teeth and of the diameter of the wheels. It also gives a better surface finish to the teeth. The manufacturing tolerances may thus be reduced, thus increasing the range in which the reversing system may operate properly.

The dead zones during changes in direction of rotation of the self-winding mass 1, 2 are directly those of the planet pinions and may be adjusted, especially by the pitch chosen for the toothing, or by the number of planets 11, 12 working with the reversers 7 and 8.

What is claimed is:

1. A self-winding watch, said watch including a frame, comprising: a self-winding mass having a central part surrounded by raceways of a ball bearing, one of which is integral with said central part and another of which is integral with means for positioning and means for removably fastening to the watch frame, a reduction gear train for connecting the self-winding mass to a barrel arbor and a reversing mechanism to convert the two-directional rotational movement of said self-winding mass into a one-directional rotational movement, transmitted to said barrel arbor, wherein two first pinions of said reversing mechanism are freely pivoted, concentrically with said central part, each of the first pinions meshing with a planet pinion, the pivot pin of which is integral with said central part and the toothing of which is shaped so as to allow only unidirectional rotations of s aid first pinions in two opposed respective directions of rotation, the first pinions being integral with two second respective moving parts of said gear train, the directions of rotation of which are opposite, one with respect to the other.

2. The watch as claimed in claim 1, wherein said central part of the self-winding mass includes a tubular portion, said tubular portion including an internal surface which serves as a pivoting surface for one of said first pinions of said reversing mechanism and an external surface which serves as a pivoting surface for the other of said first pinions of the reversing mechanism.

3. The watch as claimed in claim 2, wherein one of said first pinions which is mounted so as to pivot inside the tubular portion of said central part includes two toothed members integral with two respective ends of a member mounted so as to pivot inside said tubular portion, one of the toothed members serving as an axial stop for the second of said first pinions which is mounted so as to pivot about said tubular portion.

4. The watch as claimed in claim 3, wherein said toothed members of said first pinion mounted so as to pivot inside said tubular portion are integral with two respective complementary threads serving to make them mutually integral by one screwing into the other.

5. The watch as claimed in claim 1, wherein said central part of the self-winding mass includes an annular projection and an external part having an opening fitted around said annular projection, said external part and said annular projection being fastened to each other by result of centripetal deformation of said annular projection, wherein a portion of said external part surrounds the annular projection and covers the raceways of said ball bearing.

6. The watch as claimed in claim 1, wherein each of said reversers meshes with a planet pinion including toothing of which is shaped so as to allow for rotation with the respective reverser only in one direction and including reversing systems formed by one of said reversers and the corresponding planet pinion, wherein on of said reversing systems is mounted on said central part in mirror symmetry with respect to the other of the reversing systems wherein respective relative directions of rotation about the common axis of rotation are the reverse of each other.

7. The watch as claimed in claim 1, wherein said means for positioning said raceway includes two cylindrical complementary centering surfaces and wherein the fastening means include at least two tabs which extend outside said cylindrical centering surfaces and are provided with openings for fastening screws.

8. The watch as claimed in claim 2, wherein said central part of the self-winding mass includes an annular projection and an external part having an opening fitted around said annular projection, said external part and said annular projection being fastened to each other by result of centripetal deformation of said annular projection, wherein a portion of said external part surrounds the annular projection and covers the raceways of said ball bearing.

9. The watch as claimed in claim 3, wherein said central part of the self-winding mass includes an annular projection and an external part having an opening fitted around said annular projection, said external part and said annular projection being fastened to each other by result of centripetal deformation of said annular projection, wherein a portion of said external part surrounds the annular projection and covers the raceways of said ball bearing.

10. The watch as claimed in claim 4, wherein said central part of the self-winding mass includes an annular projection and an external part having an opening fitted around said annular projection, said external part and said annular projection being fastened to each other by result of centripetal deformation of said annular projection, wherein a portion of said external part surrounds the annular projection and covers the raceways of said ball bearing.

11. The watch as claimed in claim 2, wherein each of said reversers meshes with a planet pinion including toothing which is shaped so as to allow for rotation with the respective reverser only in one direction and including reversing systems formed by one of said reversers and the corresponding planet pinion, wherein on of said reversing systems is mounted on said central part in mirror symmetry with respect to the other of the reversing systems wherein respective relative directions of rotation about the common axis of rotation are the reverse of each other.

12. The watch as claimed in claim 3, wherein each of said reversers meshes with a planet pinion including toothing which is shaped so as to allow for rotation with the respective reverser only in one direction and including reversing systems formed by one of said reversers and the corresponding planet pinion, wherein on of said reversing systems is mounted on said central part in mirror symmetry with respect to the other of the reversing systems wherein respective relative directions of rotation about the common axis of rotation are the reverse of each other.

13. The watch as claimed in claim 4, wherein each of said reversers meshes with a planet pinion including toothing which is shaped so as to allow for rotation with the respective reverser only in one direction and including reversing systems formed by one of said reversers and the corresponding planet pinion, wherein on of said reversing systems is mounted on said central part in mirror symmetry with respect to the other of the reversing systems wherein respective relative directions of rotation about the common axis of rotation are the reverse of each other.

14. The watch as claimed in claim 5, wherein each of said reversers meshes with a planet pinion including toothing which is shaped so as to allow for rotation with the respective reverser only in one direction and including reversing systems formed by one of said reversers and the corresponding planet pinion, wherein on of said reversing systems is mounted on said central part in mirror symmetry with respect to the other of the reversing systems wherein respective relative directions of rotation about the common axis of rotation are the reverse of each other.

15. The watch as claimed in claim 2, wherein said means for positioning said raceway includes two cylindrical complementary centering surfaces and wherein the fastening means include at least two tabs which extend outside said cylindrical centering surfaces and are provided with openings for fastening screws.

16. The watch as claimed in claim 3, wherein said means for positioning said raceway includes two cylindrical complementary centering surfaces and wherein the fastening means include at least two tabs which extend outside said cylindrical centering surfaces and are provided with openings for fastening screws.

17. The watch as claimed in claim 4, wherein said means for positioning said raceway includes two cylindrical complementary centering surfaces and wherein the fastening means include at least two tabs which extend outside said cylindrical centering surfaces and are provided with openings for fastening screws.

18. The watch as claimed in claim 5, wherein said means for positioning said raceway includes two cylindrical complementary centering surfaces and wherein the fastening means include at least two tabs which extend outside said cylindrical centering surfaces and are provided with openings for fastening screws.

19. The watch as claimed in claim 6, wherein said means for positioning said raceway includes two cylindrical complementary centering surfaces and wherein the fastening means include at least two tabs which extend outside said cylindrical centering surfaces and are provided with openings for fastening screws.

* * * * *